US010866016B2

(12) United States Patent
Schoonen

(10) Patent No.: US 10,866,016 B2
(45) Date of Patent: Dec. 15, 2020

(54) HEAT EXCHANGER

(71) Applicant: Franke Technology and Trademark Ltd, Hergiswil (CH)

(72) Inventor: Wilhelmus Franciscus Schoonen, BA Son (NL)

(73) Assignee: Franke Technology and Trademark Ltd, Hergiswil (CH)

( * ) Notice: Subject to any disclaimer, the term of this patent is extended or adjusted under 35 U.S.C. 154(b) by 386 days.

(21) Appl. No.: 15/306,599

(22) PCT Filed: Apr. 27, 2015

(86) PCT No.: PCT/EP2015/059038

§ 371 (c)(1),
(2) Date: Oct. 25, 2016

(87) PCT Pub. No.: WO2015/162288

PCT Pub. Date: Oct. 29, 2015

(65) Prior Publication Data

US 2017/0045275 A1 Feb. 16, 2017

(30) Foreign Application Priority Data

Apr. 25, 2014 (EP) ..... 14166068

(51) Int. Cl.
*F25B 39/02* (2006.01)
*F28F 1/36* (2006.01)
(Continued)

(52) U.S. Cl.
CPC ..... *F25B 39/02* (2013.01); *F25B 43/006* (2013.01); *F28F 1/36* (2013.01); *F28F 27/02* (2013.01); *F28D 7/024* (2013.01); *F28F 1/38* (2013.01)

(58) Field of Classification Search
CPC . F25B 39/02; F25B 43/006; F28F 1/36; F28F 1/38; F28F 27/02; F28D 7/027; F28D 7/024
(Continued)

(56) References Cited

U.S. PATENT DOCUMENTS 1,675,108 A 6/1928 Kellogg
3,858,646 A 1/1975 Naylor
(Continued)

FOREIGN PATENT DOCUMENTS

DE 102012204057 9/2013
EP 141238 5/1985
(Continued)

*Primary Examiner* — David J Teitelbaum
(74) *Attorney, Agent, or Firm* — Volpe Koenig

(57) ABSTRACT

A vessel for containing a refrigerant comprising an inner wall and an outer wall arranged concentrically and having an inner space bounded by the inner wall and outer wall, an inlet and an outlet for transport of refrigerant into and out of the inner space; a tube inside the inner space arranged turn around the inner wall; an input tube fluidly connected to the inner space and arranged to allow flow of the refrigerant through the input tube into the inner space; an output tube connected to the inner space and arranged to allow flow of the refrigerant out of the inner space into the output tube; a compressor arranged to receive the refrigerant from the output tube and to compress the refrigerant; and a condenser arranged to receive the compressed refrigerant fluid from the compressor, to condense the refrigerant, and to forward the compressed refrigerant into the input tube.

11 Claims, 6 Drawing Sheets

(51) Int. Cl.

| | |
|---|---|
| ***F28F 27/02*** | (2006.01) |
| ***F25B 43/00*** | (2006.01) |
| *F28D 7/02* | (2006.01) |
| *F28F 1/38* | (2006.01) |

(58) Field of Classification Search
USPC ..... 62/399; 165/299
See application file for complete search history.

(56) References Cited

U.S. PATENT DOCUMENTS 5,079,927 A * 1/1992 Rodino ..... F25D 31/003 62/389
5,379,832 A 1/1995 Dempsey
5,622,055 A * 4/1997 Mei ..... F25B 40/00 62/113
6,386,272 B1 * 5/2002 Starner ..... G01B 7/06 165/11.1
2010/0000246 A1 1/2010 Thiry
2013/0240177 A1 * 9/2013 Howard ..... F28F 1/00 165/104.11
2013/0306299 A1 * 11/2013 Morita ..... B01J 19/0013 165/279

FOREIGN PATENT DOCUMENTS

| | | |
|---|---|---|
| EP | 0684434 | 11/1995 |
| GB | 1247580 | 9/1971 |
| JP | 2002255288 | 9/2002 |
| JP | 2006266550 | 10/2006 |
| JP | 200947403 | 3/2009 |
| JP | 2010519495 | 6/2010 |
| SU | 315894 | 10/1971 |
| SU | 1606819 | 11/1990 |
| WO | 2006059208 | 6/2006 |
| WO | 2009014154 | 1/2009 |
| WO | 2014000017 | 1/2014 |
| WO | 2017080573 | 5/2017 |
| WO | 2017080586 | 5/2017 |

* cited by examiner

HEAT EXCHANGER

FIELD OF THE INVENTION

The invention relates to an apparatus for cooling a fluid. More particularly, the invention relates to a heat exchanger for refrigerating a fluid. Moreover, the invention relates to a method of refrigerating a fluid.

BACKGROUND

Generally, a fluid cooler is used to cool water or another fluid. Such fluid coolers are widely employed in industry, household appliances, drinking establishments, restaurants as for example fast food restaurants, catering industry, etc. The fluid refrigerated by the fluid cooler often should be dispensed, for example in a glass. In this kind of industry, it is known to use fluid coolers including a refrigerating vessel comprising a tube containing refrigerant that goes through the inside of the refrigerating vessel. In this way, a fluid to be cooled can be stored inside of the refrigerant vessel; and the refrigerant that flows through the tube, can cool the fluid. However, usually the dimensions of such kind of fluid coolers are big, therefore using a large amount of space in the establishments wherein they are used. Another drawback of these fluid coolers is that they are energy inefficient.

More generally, heat exchangers are known to be used in refrigerating systems. However, there would be a need for an improved heat exchanger.

GB 1247580 discloses a refrigerating system including a compressor, a condenser, a fluid line, and a cooling unit wherein this cooling unit comprises an annular refrigerant chamber containing refrigerant.

DE 10 2012 204057 further discloses a heat exchanger comprising a cavity which is filled with refrigerant coming out of an evaporator in order to regulate the temperature of the refrigerant before sending it to the condenser.

SUMMARY

It would be advantageous to have an improved way of refrigerating a fluid. To better address this concern, a first aspect of the invention provides a heat exchanger for refrigerating a fluid in a refrigerating system, comprising:

a vessel for containing a refrigerant, the vessel comprising an inner wall and an outer wall, wherein the inner wall and the outer wall are concentric, wherein the vessel has an inner space bounded by at least the inner wall and the outer wall, the vessel comprising an inlet and an outlet for transport of refrigerant into and out of the inner space; and a tube inside the inner space arranged in at least one turn around the inner wall.

This configuration allows a tube to extend through the inner space without sudden turns or twists of the tube, so that fluid may flow through the tube without being agitated. For example, the tube may be arranged in a turn or coil-like fashion with one or more turns around the inner wall.

For example, the tube may be rigid.

A space may be maintained between the tube and a wall of the inner space. Also, a space may be maintained between different portions of the tube. This way, the refrigerant can have better contact the tube and exchange heat with a fluid inside the tube.

The vessel may comprise an evaporator. This provides an improved refrigerating system. For example, the inner space is an evaporator. For example, the vessel can be filled with a refrigerant in liquid and/or gaseous phase. A fluid to be refrigerated can flow through the tube therefore being refrigerated by the refrigerant that surrounds the tube inside the vessel. The heat exchanger thus provides an efficient refrigeration of the fluid inside the tube. The shape of the heat exchanger makes it compact, therefore it may allow the refrigerating system to be small and saving space. The circulation of the fluid to be refrigerated through the tube may allow for an efficient refrigeration of the fluid, thus allowing to save energy. By selecting the dimensions of the heat exchanger, including the length of the tube inside the vessel, and considering a time it takes the fluid to flow through the tube inside the inner space, a heat exchanger may be made in which the fluid has a predetermined temperature determined by the temperature of the refrigerant, when it exits the tube inside the inner space.

The vessel may comprise a first orifice and a second orifice, and the tube may comprise a first end and a second end, wherein the first end of the tube is arranged to be fixed to the first orifice of the vessel wall and the second end of the tube is arranged to be fixed to the second orifice of the vessel wall, to enable fluid communication into and/or out of the tube through the first orifice and the second orifice. This facilitates the flow of a fluid to be refrigerated through the tube inside the vessel. By selecting the dimensions of the heat exchanger, including the length of the tube inside the vessel, and considering an average speed of the fluid through the tube, a heat exchanger may be made in which the fluid has a predetermined temperature when it exits the tube and the vessel through the first or second orifice. It will be understood that the tube may be disposed inside the vessel only in part. In particular, the terms "first end" and "second end" may denote portions of the tube where the tube intersect the vessel wall.

The heat exchanger may comprise a refrigerant input tube connected to the inlet of the vessel and arranged to allow the flow of a refrigerant through the refrigerant input tube into the inner space; and a refrigerant output tube connected to the outlet of the vessel and arranged to allow the flow of a refrigerant out of the inner space into the refrigerant output tube. This facilitates the flow of refrigerant out of and into the vessel.

The inner space may contain refrigerant that is partly in liquid state and partly in gaseous state. The outlet may be located above a highest level of the liquid refrigerant. This may protect a compressor from malfunctioning, as it allows for the refrigerant leaving the vessel at the higher part of the vessel, where the refrigerant is in a gaseous state, thus helping to avoid the flow of refrigerant in liquid state from the vessel to the compressor. It is noted that refrigerant in liquid state may cause damage to the compressor. The inlet may also be located above a highest level of the liquid refrigerant. This would prevent liquid refrigerant from flowing back.

The first orifice may be arranged at two thirds of a height of the vessel or higher, and the second orifice may be arranged at one third of the height of the vessel or lower, wherein the height is measured along a concentricity axis. This may provide an advantage for refrigerating a fluid, as it allows for the fluid leaving the vessel after being refrigerated at the lower part of the vessel, where the temperature of the refrigerant may be lower than at a higher part of the vessel.

The tube may be arranged with a plurality of turns around the inside wall. In this way, the tube can be designed such that the fluid inside of the tube will go through the refrigerant as many times as necessary in view of the desired heat exchange. Furthermore, the fluid to be refrigerated may flow smoothly through the tube, in particular because the configuration in which the tube is arranged with turns around the inside wall allows the tube to be smoothly shaped. This provides an advantage for refrigerating for instance soda beverages such as beer, as the fluid traveling through the tube will be less agitated.

The tube may be arranged to occupy at least two thirds of a volume of the inner space. This increases the efficiency of the heat exchanger, as the fluid to be refrigerated will pass through the inner tube, and therefore through the refrigerant, during a greater amount of time, therefore reaching a lower temperature for the same pressure and saving energy. Moreover, less refrigerant may be needed to fill the inner space.

The heat exchanger may further comprise a pressure control means configured to control a pressure in the inner space based on a target temperature. In this way, a target temperature is achieved efficiently.

The heat exchanger may further comprise a temperature sensor configured to measure a temperature of the refrigerant inside the inner space and/or the fluid inside the tube. This allows for improving the control of the temperature of the fluid to be refrigerated. For example, the pressure control means may be configured to control the pressure based on the target temperature and the measured temperature.

The inner space may have a shape of a toroid. This allows a compact construction of the heat exchanger, therefore saving space.

A first end of the tube may be operatively connected to a fluid container and may be arranged to allow the flow of a fluid to be refrigerated from the fluid container into the tube, and a second end of the tube may be operatively connected to a tap and may be arranged to allow the flow of the refrigerated fluid out of the inner tube into the tap. This allows for an efficient way of dispensing a refrigerated fluid.

In another aspect, the invention provides a method of refrigerating a fluid, the method comprising the steps of:

controlling flow of a refrigerant through an input tube fluidly connected to an inner space of a vessel through the input tube into the inner space and flow of the refrigerant out of the inner space into an output tube connected to the inner space, wherein the vessel comprises an inner wall and an outer wall, wherein the inner wall and the outer wall are concentric and the inner space is bounded by at least the inner wall and the outer wall, the vessel comprising an inlet and an outlet for transport of refrigerant into and out of the inner space, and wherein the vessel further comprises a tube inside the inner space arranged in at least one turn around the inner wall; and controlling flow of a fluid to be refrigerated through the inner tube.

The person skilled in the art will understand that the features described above may be combined in any way deemed useful. Moreover, modifications and variations described in respect of the system may likewise be applied to the method and vice versa.

BRIEF DESCRIPTION OF THE DRAWINGS

These and other aspects of the invention are apparent from and will be elucidated with reference to the embodiments described hereinafter in the drawings. Throughout the figures, similar items have been indicated by the same reference numerals. The figures are drawn schematically for illustration purpose, and may not be drawn to scale.

DETAILED DESCRIPTION OF THE PREFERRED EMBODIMENTS

The figures, discussed herein, and the various embodiments used to describe the principles of the present disclosure in this patent document are by way of illustration only and should not be construed in any way to limit the scope of the disclosure. Those skilled in the art will understand that the principles of the present disclosure may be implemented in any suitable method or any suitably arranged system or device.

Figure 1A:
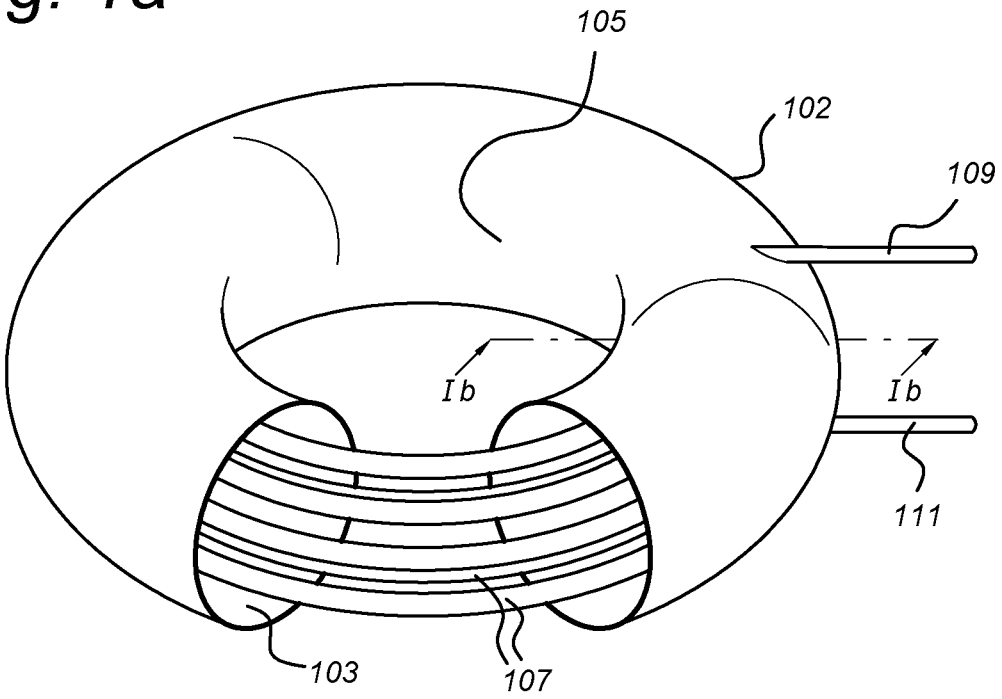
FIG. 1A shows a partly worked open view of a heat exchanger for refrigerating a fluid.
Figure 1B:
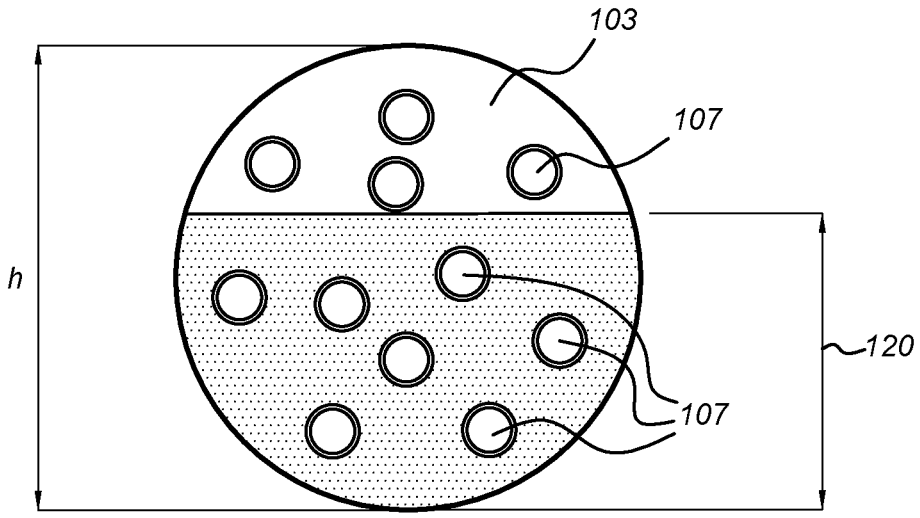
FIG. 1B shows a cross section in longitudinal direction of the heat exchanger for refrigerating a fluid of FIG. 1A.

FIG. 1A illustrates a partly worked open view of a vessel for refrigerating a fluid. The vessel comprises an inner wall 105 and an outer wall 102. The inner wall 105 and the outer wall 102 may be concentric. The vessel further comprises an inner space 103 bounded by at least the inner wall 105 and the outer wall 102. The upper end of the inner wall and the upper end of the outer wall may be connected by means of an upper wall. Likewise, the lower end of the inner wall and the lower end of the outer wall may be connected by means of a lower wall. It will be understood that there need not be a clear boundary between upper/lower walls and inner/outer walls. This is particularly so for the inner space with circular cross section as illustrated in FIG. 1A and FIG. 1B. The inner space may be fluidly closed, so that the refrigerant cannot escape from the refrigeration system. The inner space 103 may have substantially a ring shape. The inner space 103 may alternatively have any other suitable shape. The vessel may comprise an inlet and an outlet (not shown) for transport of a fluid, typically refrigerant, into and out of the inner space 103. The outlet may be connectable to a compressor (not shown) and the inlet may be connectable to a condenser (not shown). The vessel may have more than one inlet and/or more than one outlet. The vessel further comprises a tube 107 inside the inner space 103. The tube 107 may be arranged in at least one turn around the inner wall 105. However, the tube 107 may be arranged with a plurality of turns around the inside wall 105, in a coil shape. The plurality of turns may be any suitable number such that the tube is arranged to occupy a predetermined amount of a volume of the inner space 103. However, this is not a limitation. For instance, the tube may be arranged to occupy at least two thirds of the volume of the inner space. Alternatively, the tube may have any size.

FIG. 1B shows a cross section in longitudinal direction of a part of the heat exchanger for refrigerating a fluid of FIG. 1A. The tube 107 going through the inner space 103 in several turns around the inner wall 105 is illustrated. The inner space 103 may be filled with liquid refrigerant up to a level illustrated in FIG. 1B as 109. The remainder of the inner space 103 may be filled with gaseous refrigerant. The inner space 103 may have a height illustrated in FIG. 1B as h and measured with respect to an axis to which the outer wall 102 and the inner wall 105 of FIG. 1A are concentric. For example, this concentricity axis may be oriented vertically during operation of the heat exchanger. However, this is not a limitation.

Figure 2A:
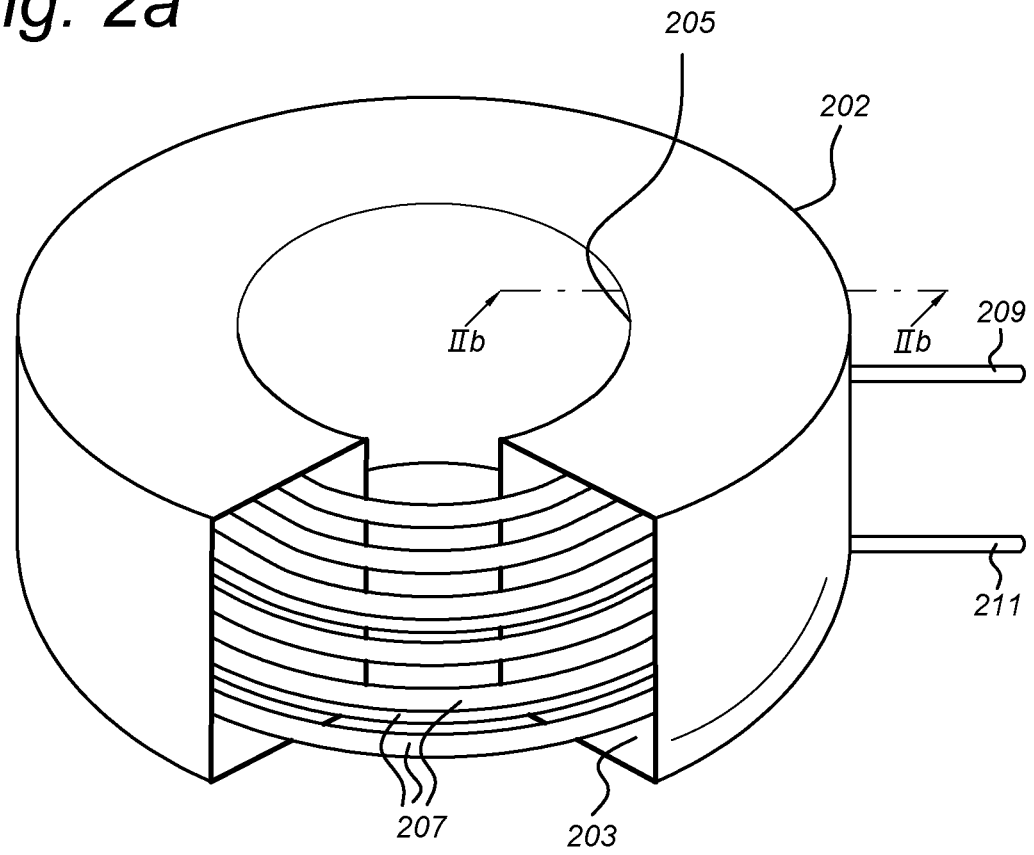
FIG. 2A shows a partly worked open view of another heat exchanger for refrigerating a fluid.

FIG. 2A illustrates a partly worked open view of a vessel for an apparatus for refrigerating a fluid. The vessel comprises an inner wall 205 and an outer wall 202. The inner wall 205 and the outer wall 202 may be concentric. The vessel further comprises an inner space 203 bounded by at least the inner wall 205 and the outer wall 202. The inner wall 205 and the outer wall 202 may have a cylindrical shape. The vessel may comprise an inlet and an outlet (not shown) for transport of a fluid, typically refrigerant, into and out of the inner space 203. The outlet may be connectable to a compressor (not shown) and the inlet may be connectable to a condenser (not shown). The vessel may have more than one inlet and/or more than one outlet. The vessel further comprises a tube 207 inside the inner space 203. The tube 207 is arranged in at least one turn around the inner wall 205. However, the tube 207 may be arranged with a plurality of turns around the inside wall 205. For example, the plurality of turns may be any suitable number such that the tube is arranged to occupy a determined amount of a volume of the inner space 203. For instance, the tube may be arranged to occupy at least two thirds of the volume of the inner space.

Figure 2B:
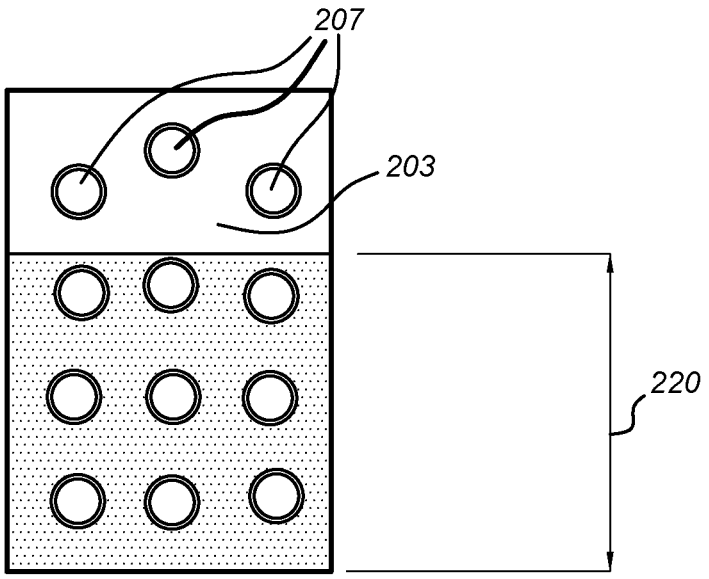
FIG. 2B shows a cross section in longitudinal direction of the heat exchanger for refrigerating a fluid of FIG. 2A.

FIG. 2B shows a cross section in longitudinal direction of a part of the heat exchanger for refrigerating a fluid of FIG. 2A. The tube 207 going through the inner space 203 is illustrated. The inner space 203 may be filled completely with refrigerant. The refrigerant may be in liquid state up to a level illustrated in FIG. 2B as 209. However, the level of the liquid refrigerant may be chosen differently. The shown level is only an example. The remainder of the inner space 203, above the level indicated by 209, may be filled with gaseous refrigerant.

Figure 3:
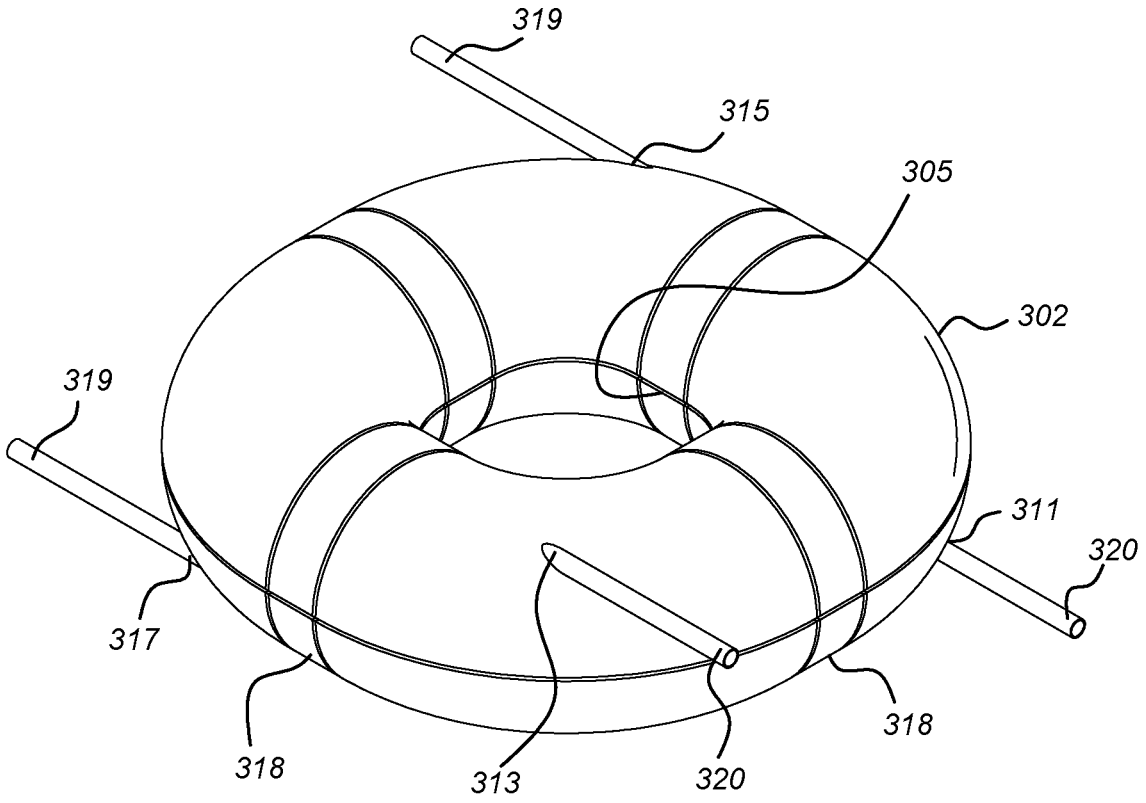
FIG. 3 shows another heat exchanger for refrigerating a fluid.

FIG. 3 illustrates another embodiment of a heat exchanger for refrigerating a fluid. The vessel comprises an inner wall 305 and an outer wall 302. The inner wall 305 and the outer wall 302 may be concentric. The vessel further comprises an inner space (not shown) bounded by at least the inner wall 305 and the outer wall 302. The inner space has a ring shape with straight sections 318. The vessel may comprise an inlet and an outlet (not shown) for transport of a fluid, typically refrigerant, into and out of the inner space. The outlet may be connectable to a compressor (not shown) and the inlet may be connectable to a condenser (not shown). The vessel may have more than one inlet and/or more than one outlet. The vessel may further comprise a first tube and a second tube disposed inside the inner space. The first tube and the second tube may each be arranged in at least one turn around the inner wall 305. The first tube and the second tube may be arranged with a plurality of turns around the inside wall 305. The plurality of turns may be any suitable number. For example, the number of turns may be such that the first tube and/or the second tube are arranged to occupy a determined amount of a volume of the inner space. For instance, the first and/or the second tube may be arranged to occupy at least two thirds of the volume of the inner space. The vessel may comprise two input orifices and two output orifices. The first tube 319 may enter the vessel at a first input orifice 315 and may exit the vessel at a first output orifice 317. The second tube 320 may enter the vessel at a second input orifice 313 and may exit the vessel at a second output orifice 311. The number of tubes is not limited to one or two. Alternative embodiments of the vessel may comprise any number of tubes going through the inner space. The vessel may comprise orifices at any part of the vessel. The tubes may exit and/or enter the vessel through any of those orifices. The tubes may be fixed to the orifices in such a way that the vessel is fluidly closed around the tubes, so that no refrigerant can escape from the vessel through the orifice.

Figure 4:
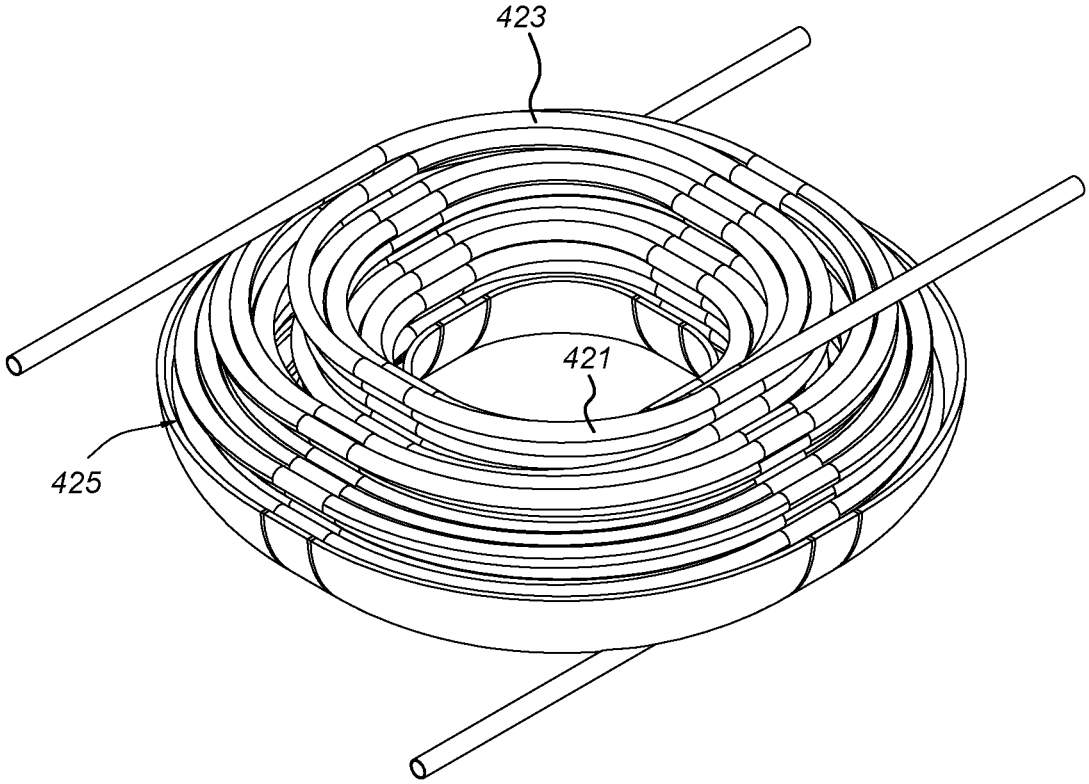
FIG. 4 shows a partly worked open view of the heat exchanger for refrigerating a fluid of FIG. 3.

FIG. 4 shows a worked open view of the heat exchanger shown in FIG. 3. The first tube 421 and the second tube 423 going through the inner space 425 are illustrated. The different tubes going through the inner space of the vessel may cross their ways or be disposed at any suitable form.

Figure 5:
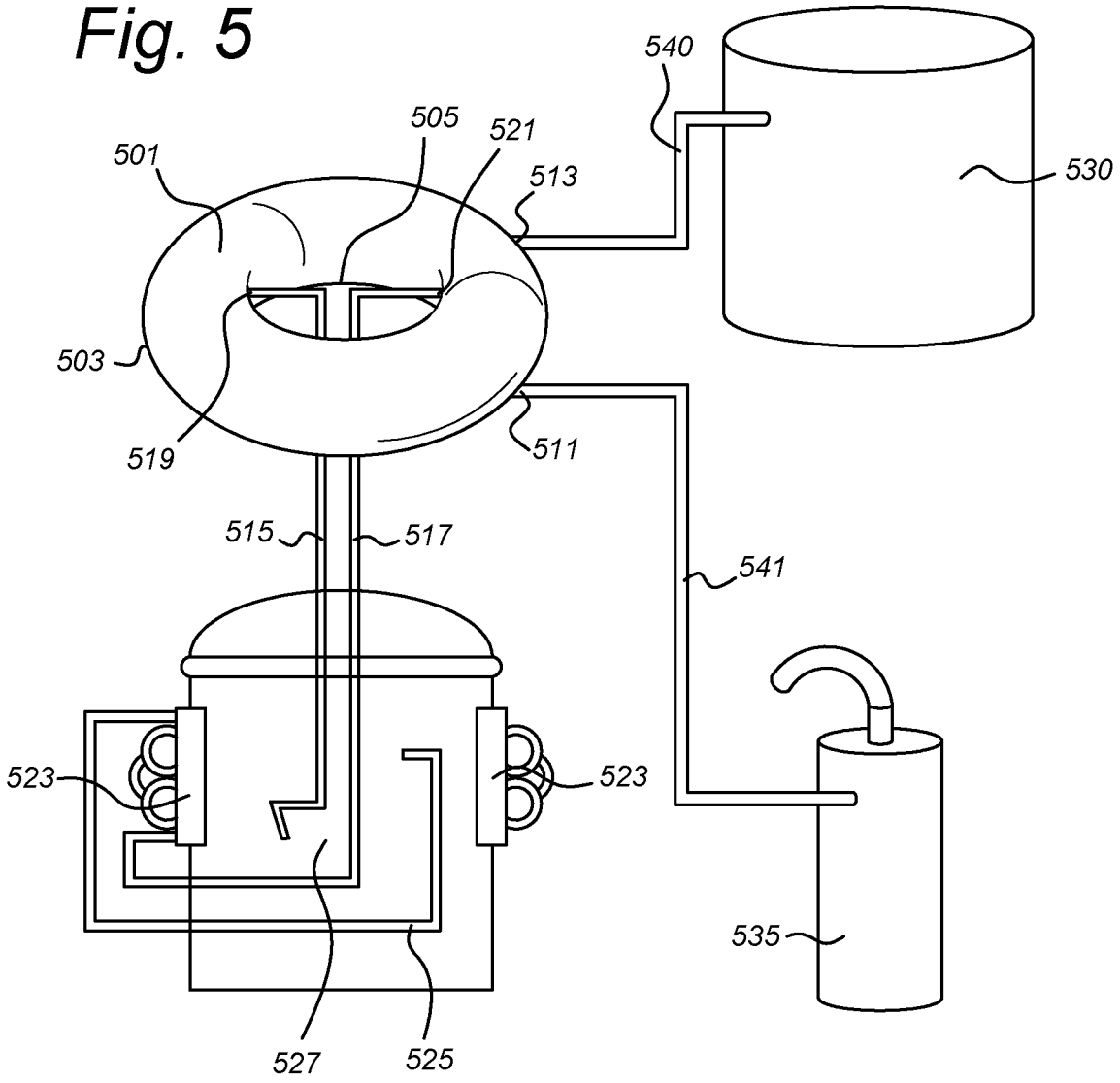
FIG. 5 shows a refrigerating system.

FIG. 5 illustrates a refrigerating system. The refrigerating system may comprise a vessel 501 for containing a refrigerant. In the embodiment of FIG. 5, the vessel 501 is a vaporizer used to cool a fluid flowing through the tube inside the inner space of the vessel 501. The vessel 501 may comprise an inner wall 505 and an outer wall 503. The inner wall 505 and the outer wall 503 may be concentric. The vessel 501 may have an inner space bounded by at least the inner wall 505 and the outer wall 503. The vessel 501 may comprise a tube (not shown) inside the inner space arranged in at least one turn around the inner wall. The tube may be arranged with a plurality of turns around the inside wall. For example, the inner space of the vessel 501 may have a shape of a toroid. The tube inside the inner space may have a shape of a coil. The vessel 501 may be similar to those of the apparatus of any one of FIGS. 1A, 1B, 2A, 2B, 3, and 4.

The vessel may comprise a first orifice 513 and a second orifice 511. The first orifice 513 and the second orifice 511 may be in the outer wall 503 of the vessel 501. The first orifice 513 may be arranged at two thirds of the height or higher. The second orifice 511 may be arranged at one third of the height or lower. Alternatively, the first orifice 513 may be located above the level illustrated in FIG. 1B as 109 up to which the inner space 103 is filled with gaseous refrigerant. The second orifice 511 may be located below the level illustrated in FIG. 1B as 109 up to which the inner space 103 is filled with liquid refrigerant. The first orifice 513 and the second orifice 511 may be located in any suitable place of the vessel 501. The tube may comprise a first end and a second end. The first end of the tube may be fixed to the first orifice 513 of the vessel 501 and the second end of the tube may be fixed to the second orifice 511 to enable fluid communication into and/or out of the tube through the first orifice 513 and the second orifice 511. The vessel and tube may be constructed in such a way that there is no fluid communication between the inside of the tube and the rest of the inner space. However, the material of the tube may be selected such that an exchange of heat between the refrigerant in the inner space and the fluid inside the tube does take place.

The first end of the tube may be connected to a fluid container 530 by means of further tubing 540. At least part of the further tubing 540 and the tube inside the inner space may form one integral tube. Alternatively, the further tubing 540 and the tube inside the inner space may be operatively connected to each other. In either case, the further tubing may allow the flow of a fluid to be refrigerated from the fluid container 530 into the tube portion inside the inner space. The second end of the tube may be operatively connected to a tap 535, for example via further tubing 541, and may be arranged to allow the flow of the refrigerated fluid out of the inner tube into the tap. Similar to the further tubing 540, at least part of the further tubing 541 may form an integral tube with the tube inside the inner space. Alternatively, the further tubing 541 and the tube inside the inner space may be operatively connected to each other, for example at the orifice 511.

The vessel 501 may further comprise an inlet 521 and an outlet 519. The refrigerating system of FIG. 5 may further comprise a refrigerant input tube 517 and a refrigerant output tube 515. The refrigerant input tube 517 may be connected to the inlet 521 and arranged to allow the flow of a refrigerant through the refrigerant input tube 517 into the inner space of the vessel 501. The refrigerant output tube 515 may be connected to the outlet 519 and arranged to allow the flow of a refrigerant out of the inner space of the vessel 501 into the refrigerant output tube 515.

The refrigerating system of FIG. 5 may further comprise a compressor 527 and a condenser 523. The refrigerant output line 515 may fluidly connect the inner space of the vessel 501 with the compressor 527. The compressor 527 may be arranged to receive the refrigerant from the output line 515 and to compress the refrigerant. The compressor 527 may comprise a discharge line 525 operatively connected to the compressor 527 and arranged to allow the flow of the compressed refrigerant out of the compressor 527. The discharge line 525 may be further operatively connected to the condenser 523. The condenser 523 may be arranged to receive the compressed refrigerant from the discharge line 525. The condenser 523 may be arranged to receive the compressed refrigerant from the compressor 527. The condenser 523 may be further arranged to condense the refrigerant. The condenser 523 may be arranged to forward the compressed and condensed refrigerant into the input line 517 towards the vessel 501.

The refrigerating system of FIG. 5 may comprise pressure control means (not shown) arranged to control a pressure of the refrigerant in the vessel 501 based on a target temperature. The refrigerating system may further comprise a temperature sensor configured to measure a temperature of heat exchanger inside the inner space 607 or fluid inside the tube 631. Alternatively or additionally, the system may comprise a pressure sensor configured to measure the pressure of the refrigerant inside the inner space 607. The control means may comprise a table or other kind of mapping which relates temperature values to corresponding refrigerant pressure values.

The refrigerating system may comprise more than one vessel (not shown) connected to the refrigerated system in parallel. The refrigerated system may comprise furthermore more than one tap, each tap connected to the inner tube of a different vessel. The refrigerated system may further comprise more than one fluid container, containing each one a fluid to be refrigerated and connected each one to an inner tube of a different vessel. Each vessel may have its own pressure/temperature control set forth above.

The condenser of the refrigerating system of FIG. 5 may comprise, for example, a vessel as presented in FIGS. 1A, 1B, 2A, 2B, 3, and 4.

Figure 6:
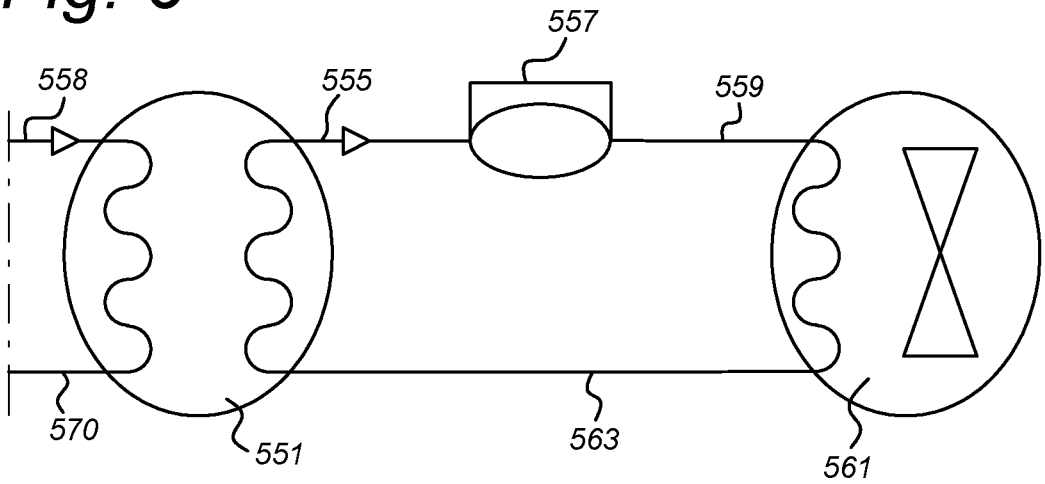
FIG. 6 shows a schematic of a refrigerating system.

FIG. 6 shows a schematic of a refrigerating system. The refrigerating system of FIG. 6 comprises an evaporator 551, a compressor 557 and a condenser 561. The evaporator 551 may comprise a vessel 501 as the one presented in FIG. 5. The evaporator 551 may comprise as well a vessel as the ones presented in FIGS. 1A, 1B, 2A, 2B, 3, and 4. Alternatively, the evaporator 511 may be any evaporator known in the art.

The refrigerating system of FIG. 6 may comprise furthermore a fluid input tube 558 which may be operatively connected to the evaporator 558 for allowing a fluid to be cooled by means of the evaporator 551. The refrigerating system of FIG. 6 may comprise as well a fluid output tube 570 which may be operatively connected to the evaporator 551 for allowing the flow of a fluid out of the evaporator. The refrigerating system may further comprise a suction line 555. One of the ends of the suction line 555 may be fluidly connected to the evaporator 551 and arranged to allow the flow of a refrigerant out of the evaporator 551. The other end of the suction line 555 may be further operatively connected to the compressor 557. The compressor 557 may be arranged to cause the flow of a refrigerant from the evaporator 551 to the compressor 557 through the suction line 555. The compressor 557 may be arranged to compress the refrigerant received from the suction line 555. The refrigerating system may further comprise a discharge line 559 fluidly connecting the compressor 557 to the condenser 561 and arranged to allow the flow of the compressed refrigerant from the compressor 557 to the condenser 561. The condenser 561 may be arranged to condense the compressed refrigerant received from the compressor. The condenser 561 may be any suitable condenser known in the art. Alternatively, the condenser 561 may comprise a vessel 501 similar to the one presented in FIG. 5, or a vessel similar to the ones presented in FIGS. 1A, 1B, 2A, 2B, 3, and 4. In such a case, the refrigerant may be condensed inside the inner space of the vessel. A cooling fluid may be arranged to flow through the tube or tubes, to further cool down the refrigerant.

The refrigerating system may further comprise a line 563 fluidly connecting the condenser 561 to the evaporator 551 and arranged to allow the flow of a condensed refrigerant from the condenser to the evaporator 551. In the embodiments illustrated herein, the apparatus is constructed in such a way that the inside of the tube is fluidly isolated from the refrigerant. Heat exchange takes place between the inside and outside of the tube. However, the refrigerant normally cannot flow into the inside of the tube. However, this is not a limitation.

Figure 7:
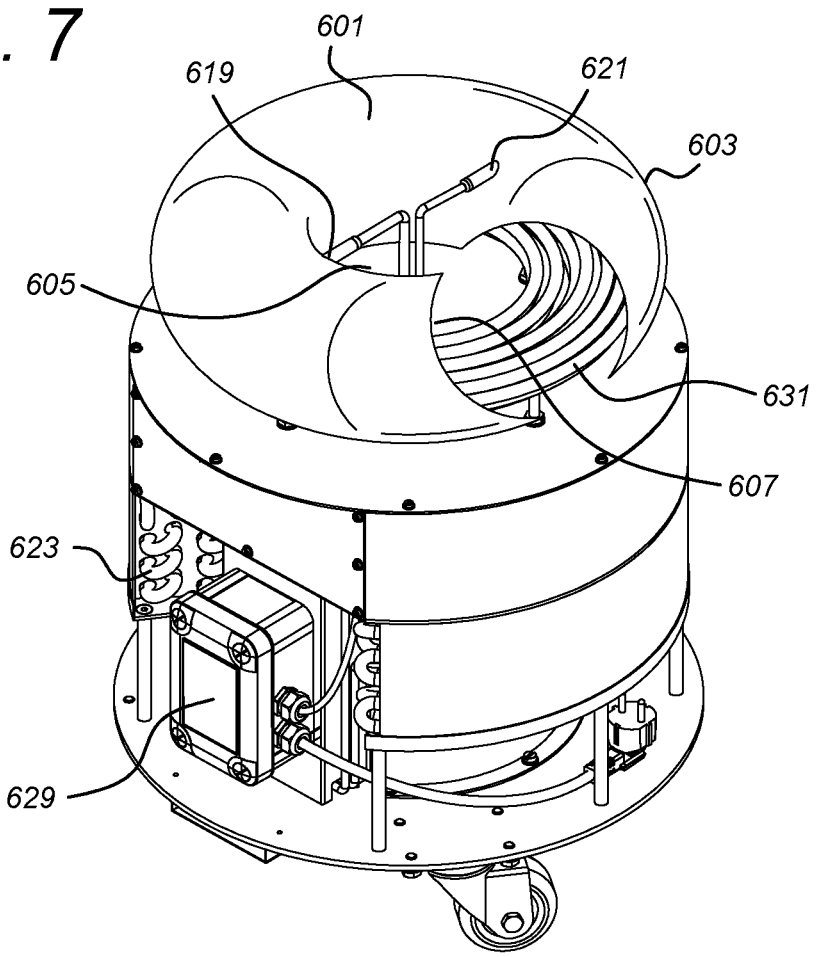
FIG. 7 shows a partly worked open view of an apparatus for refrigerating a fluid.

FIG. 7 shows a partly worked open view of an apparatus for refrigerating a fluid. The apparatus of FIG. 7 may comprise a heat exchanger 601. The heat exchanger 601 may comprise an inner wall 605 and an outer wall 603. The inner wall 605 and the outer wall 603 may be concentric. The heat exchanger 601 may have an inner space 607 bounded by at least the inner wall 605 and the outer wall 603. The heat exchanger 601 may comprise a tube 631 inside the inner space 607 arranged in at least one turn around the inner wall 605. The tube 631 may be arranged with a plurality of turns around the inner wall 605. The inner space 601 may have a shape of a toroid or donut. The heat exchanger 601 may be similar to one of the apparatuses shown in FIGS. 1A, 1B, 2A, 2B, 3, 4, and 5. The heat exchanger 601 may be used as the vaporizer and cooling element of the apparatus.

The heat exchanger may comprise a first orifice and a second orifice (not shown). The first orifice and the second orifice may be in the outer wall 603 of the heat exchanger 601. For example, the first orifice may be arranged at two thirds of the height of the heat exchanger 601 or higher. For example, the second orifice may be arranged at one third of the height or lower. Alternatively, the first orifice and the second orifice may be located in any suitable place of the heat exchanger 601. The tube 631 comprises a first end and a second end (not shown). The first end of the tube may be fixed to the first orifice and the second end of the tube may be fixed to the second orifice to enable fluid communication into and/or out of the tube 631 through the first orifice and the second orifice.

The first end of the tube may be operatively connected to a fluid container (not shown) and arranged to allow the flow of a fluid to be refrigerated from the fluid container (not shown) into the tube 631. For example, the fluid container contains consumable liquid suitable for beverages, such as water, soda drink, or beer. For example the consumable liquid is a carbonated beverage. The second end of the tube may be operatively connected to a tap (not shown) and arranged to allow the flow of the refrigerated fluid out of the inner tube 631 into the tap.

The heat exchanger 601 may further comprise an inlet 621 and an outlet 619. The refrigerating system of FIG. 7 may further comprise a refrigerant input tube and a refrigerant output tube (not shown). The refrigerant input tube may be connected to the inlet 621 and arranged to allow the flow of a refrigerant through the refrigerant input tube into the inner space 607. The refrigerant output tube may be connected to the outlet 619 and arranged to allow the flow of a refrigerant out of the inner space 607 into the refrigerant output tube.

The refrigerating system of FIG. 7 may further comprise a compressor (not shown) and a condenser 623. The refrigerant output line may enter the compressor. The compressor may be arranged to receive the refrigerant from the output line and to compress the refrigerant. The compressor may comprise a discharge line (not shown) operatively connected to the compressor and arranged to allow the flow of the compressed refrigerant out of the compressor. The discharge line may be further operatively connected to the condenser 623. The condenser 623 may be arranged to receive the compressed refrigerant from the discharge line. The condenser 623 may be arranged to receive directly the compressed refrigerant from the compressor. The condenser 623 may be further arranged to condense the refrigerant. The condenser 623 may be arranged to forward the compressed refrigerant into the input line.

The refrigerating apparatus of FIG. 7 may further comprise a power source 629 to provide electricity to electric components of the refrigerating apparatus.

The inner wall 619 may surround any other suitable element or material. For example, a component of the refrigerating system could be disposed in the open center of the vessel. Alternatively, isolating material may be placed there and/or around the heat exchanger 601.

Figure 8:
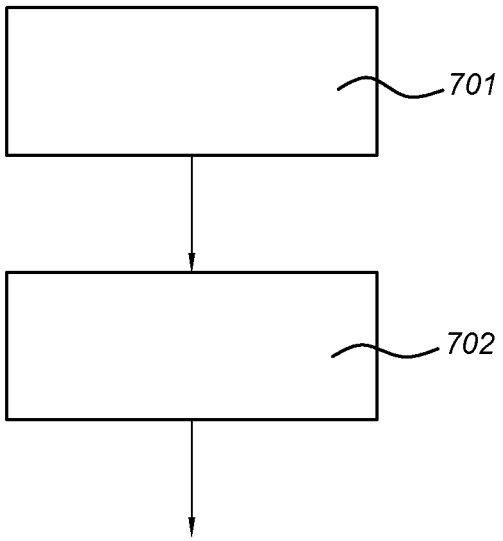
FIG. 8 shows a flowchart of a method of refrigerating a fluid.

FIG. 8 shows a flowchart of a method of refrigerating a fluid. The method of refrigerating a fluid may comprise a step 701 comprising controlling flow of refrigerant to pass through an input tube fluidly connected to an inner space of a vessel through the input tube into the inner space and controlling flow of the refrigerant out of the inner space into an output tube connected to the inner space, wherein the vessel comprises an inner wall and an outer wall, wherein the inner wall and the outer wall are concentric and the inner space is bounded by at least the inner wall and the outer wall, the vessel comprising an inlet and an outlet for transport of refrigerant into and out of the inner space arranged in at least one turn around the inner wall.

The method may further comprise a step 702. Step 702 comprises controlling a flow of a fluid to be refrigerated to pass through the inner tube.

The controlling method may comprise a further step (not shown) comprising controlling a pressure in the vessel based on a target temperature.

It will be appreciated that the above-mentioned three steps may be performed simultaneously, so that a continuous supply of refrigerated liquid is supplied.

It should be noted that the above-described embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. A heat exchanger for refrigerating a fluid in a refrigerating system, comprising:

a vessel (501, 601) for containing a refrigerant, the vessel comprising an inner wall (505, 605) and an outer wall (503, 603), the inner wall and the outer wall are concentric, an inner space bounded by at least the inner wall and the outer wall, and an inlet (521, 621) and an outlet (519, 619) for transport of refrigerant into and out of the inner space (607);

a tube (631) inside the inner space (607) arranged in a plurality of turns around the inner wall and is adapted to be surrounded by the refrigerant, the tube (631) is arranged to occupy at least two thirds of a volume of the inner space (607) with the plurality of turns being spaced apart from one another;

the outlet (519, 619) is adapted to be located above a highest level (120, 220) of a liquid portion of the refrigerant, and the tube (631) is adapted to be at least partly located within a bath of the liquid portion of the refrigerant; and a pressure controller configured to control a pressure of the refrigerant in the inner space based on a target temperature of a fluid inside the tube.

2. The heat exchanger of claim 1, wherein the vessel (501, 601) comprises a first orifice (513) and a second orifice (511), and the tube comprises a first end and a second end, and the first end of the tube is fixed to the first orifice (513) of the vessel wall and the second end of the tube is fixed to the second orifice (511) of the vessel wall, to enable fluid communication at least one of into or out of the tube (631) through at least one of the first orifice or the second orifice.

3. The heat exchanger of claim 1, further comprising:

a refrigerant input tube (517) connected to the inlet (521, 621) of the vessel and arranged to allow a flow of a refrigerant through the refrigerant input tube into the inner space (607); and a refrigerant output tube (515) connected to the outlet (519, 529) of the vessel and arranged to allow flow of the refrigerant out of the inner space (607) into the refrigerant output tube (515).

4. The heat exchanger of claim 3, wherein the first orifice (513) is arranged at two thirds of a height of the vessel (501, 601) or higher, and the second orifice (511) is arranged at one third of the height of the vessel (501, 601) or lower, and the height is measured along a concentricity axis.

5. The heat exchanger of claim 1, wherein the tube (631) is arranged with a plurality of turns around the inside wall (505, 605).

6. The heat exchanger of claim 1, wherein the inner space (607) has a shape of a toroid.

7. A refrigerating system comprising:

a heat exchanger according to claim 1;

an input tube fluidly connected to the inner space and arranged to allow a flow of the refrigerant through the input tube into the inner space;

an output tube fluidly connected to the inner space and arranged to allow a flow of the refrigerant out of the inner space into the output tube;

a compressor (527) arranged to receive the refrigerant from the output tube and to compress the refrigerant; and a condenser (523) arranged to receive the refrigerant that has been compressed fluid from the compressor, to condense the refrigerant, and to forward the compressed refrigerant into the input tube.

8. The refrigerating system of claim 7, further comprising a fluid container (530) and a tap (535), wherein a first end of the tube is operatively connected to the fluid container (530) and arranged to allow the flow of a fluid to be refrigerated from the fluid container (530) into the tube (631), and a second end of the tube is operatively connected to the tap (535) and arranged to allow the flow of the refrigerated fluid out of the tube (631) into the tap (535).

9. The heat exchanger of claim 1, wherein the inlet is adapted to be located above the highest level of the liquid portion of the refrigerant.

10. A heat exchanger for refrigerating a fluid in a refrigerating system, comprising:

a vessel (501, 601) for containing a refrigerant, the vessel comprising an inner wall (505, 605) and an outer wall (503, 603), the inner wall and the outer wall are concentric, an inner space bounded by at least the inner wall and the outer wall, and an inlet (521, 621) and an outlet (519, 619) for transport of refrigerant into and out of the inner space (607);

a tube (631) inside the inner space (607) arranged in at least one turn around the inner wall and is adapted to be surrounded by the refrigerant; and the outlet (519, 619) is adapted to be located above a highest level (120, 220) of a liquid portion of the refrigerant, and the tube (631) is adapted to be at least partly located within a bath of the liquid portion of the refrigerant;

a pressure controller configured to control a pressure in the vessel based on a target temperature;

a temperature sensor configured to determine a measured temperature of fluid inside the tube (631); and the pressure controller being further configured to control the pressure of the refrigerant in the inner space based on the target temperature and the measured temperature of the fluid inside the tube.

11. A method of refrigerating a fluid, the method comprising:

controlling (701) a flow of a refrigerant through an input tube fluidly connected to an inner space of a vessel through the input tube into an inner space and a flow of the refrigerant from the inner space into an output tube connected to the inner space, wherein the vessel comprises an inner wall and an outer wall, the inner wall and the outer wall are concentric and the inner space is bounded by at least the inner wall and the outer wall, an inlet and an outlet for transport of refrigerant into and out of the inner space, the outlet being adapted to be located above a highest level of the liquid refrigerant, and a tube inside the inner space arranged in a plurality of turns around the inner wall, that is adapted to be surrounded by the refrigerant and at least partly located within a bath of liquid refrigerant, the tube (631) is arranged to occupy at least two thirds of a volume of the inner space (607) with the plurality of turns being spaced apart from one another;

controlling (702) a flow of a fluid to be refrigerated through the inner tube and controlling a pressure of the refrigerant in the inner space based on a target temperature of a fluid inside the tube.

* * * * *